US010535931B2

(12) United States Patent
Yagyu

(10) Patent No.: US 10,535,931 B2
(45) Date of Patent: Jan. 14, 2020

(54) WIRE CONNECTION DEVICE

(71) Applicant: DENSO CORPORATION, Kariya, Aichi-pref. (JP)

(72) Inventor: Yuki Yagyu, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/131,152

(22) Filed: Sep. 14, 2018

(65) Prior Publication Data

US 2019/0140369 A1 May 9, 2019

(30) Foreign Application Priority Data

Nov. 6, 2017 (JP) ..... 2017-213792

(51) Int. Cl.
*H01R 4/24* (2018.01)
*H01R 4/2445* (2018.01)
*H01R 4/242* (2018.01)

(52) U.S. Cl.
CPC ..... *H01R 4/2445* (2013.01); *H01R 4/242* (2013.01)

(58) Field of Classification Search
CPC ..... H01R 4/242; H01R 4/2445
See application file for complete search history.

(56) References Cited

U.S. PATENT DOCUMENTS 3,167,357 A * 1/1965 Savin ..... B60B 27/0005 301/1
3,183,472 A * 5/1965 Pawl ..... H01R 4/2429 174/87
4,256,360 A * 3/1981 Debaigt ..... H01R 4/242 439/399
4,448,472 A * 5/1984 Hardesty ..... H01R 4/2441 439/400
5,820,402 A * 10/1998 Chiacchio ..... H01R 4/2462 439/398
2001/0039139 A1 11/2001 Herrmann et al.
2007/0190844 A1* 8/2007 Donhauser ..... H01R 4/242 439/395

* cited by examiner

*Primary Examiner* — Xuong M Chung Trans
(74) *Attorney, Agent, or Firm* — Posz Law Group, PLC

(57) ABSTRACT

A wire connection device includes an electrical wire, an insulation displacement terminal and a stress relaxation member. The electrical wire includes a conductor and an insulation coating on an outer periphery of the conductor. The insulation displacement terminal has a slot in which the electrical wire is fitted. The insulation displacement terminal is connected to the electrical wire by both side portions of the slot being in direct contact with the conductor and pressing the conductor elastically and plastically. The stress relaxation member is fitted in the slot of the insulation displacement terminal to suppress deterioration of a stress applied to the electrical wire.

7 Claims, 6 Drawing Sheets

WIRE CONNECTION DEVICE

CROSS REFERENCE TO RELATED APPLICATION

This application is based on Japanese Patent Application No. 2017-213792 filed on Nov. 6, 2017, the disclosure of which is incorporated herein by reference.

TECHNICAL FIELD

The present disclosure relates to a wire connection device in which an electrical wire is fitted in an insulation displacement terminal to obtain an electrical connection.

BACKGROUND

For example, in a motor mounted on a vehicle such as an automobile, an insulation displacement terminal is used for electrical connection between a winding of a stator and a control substrate. For example, as shown in US 2001/0039139 A1, this type of insulation displacement terminal is configured by a plate-like metal part having spring properties and having a slot for fitting. The electrical wire with an insulation coating is inserted and fitted into the slot, and both side portions of the slot of the metal part are pressed to a conductor of the electrical wire so as to cut the insulation coating. As such, an electrical connection is obtained. In this case, since contact resistance with the electrical wire needs to be lowered, a spring force of the insulation displacement terminal is increased to obtain a large fitting force (e.g., contact load) on the electrical wire.

The fitting force of the insulation displacement terminal is obtained by using an internal energy to return to the original shape, for example, which is observed in metal or resin. In this case, stress relaxation phenomenon occurs in which stress (e.g., fitting force) decreases with time elapsed after fitting. The contact load to the electrical wire gradually decreases, and, finally, necessary fitting force cannot be obtained and the insulation displacement terminal cannot sufficiently function. In particular, this stress relaxation phenomenon is accelerated as an ambient temperature increases. Even when the lifetime of the insulation displacement terminal is sufficiently long in normal temperature, there is a possibility that a desired lifetime cannot be achieved when the insulation displacement terminal is used under high temperature environment.

SUMMARY

As a method for addressing the above possibility, it is conceivable to increase the initial fitting force of the insulation displacement terminal. In US 2001/0039139 A1, the initial fitting force is increased by adding a spring clip on the metal part. However, in this method, a larger force is applied to the fitted electrical wire to cause deformation or the like due to stress concentration. For example, there is a possibility that the electrical wire is broken at the deformed portion due to external force. As another method, it is conceivable to select a material which is less likely to cause stress relaxation as the material of the insulation displacement terminal. For example, a Cu alloy obtained by adding an additive element such as Ni, Sn, P or the like to Cu may be selected. However, such material has larger electrical resistance.

It is an object of the present disclosure to provide a wire connection device that obtains an electrical connection by fitting an electrical wire in an insulation displacement terminal and that is capable of maintaining a fitting force of the insulation displacement terminal to the electrical wire over a long period of time and achieving a long lifetime.

According to an aspect of the present disclosure, a wire connection device includes an electrical wire, an insulation displacement terminal, and a stress relaxation member. The electrical wire includes a conductor and an insulation coating on an outer periphery of the conductor. The insulation displacement terminal has a slot in which the electrical wire is fitted. The insulation displacement terminal is connected to the electrical wire by both side portions of the slot being in direct contact with the conductor and pressing the conductor elastically and plastically. The stress relaxation member is fitted in the slot of the insulation displacement terminal to suppress deterioration of a stress applied to the electrical wire.

According the aspect of the present disclosure, the stress relaxation member is fitted in the slot of the insulation displacement terminal together with the electrical wire, and these two members are fitted and held by the fitting force of the insulation displacement terminal. At this time, the sum of the contact load (i.e., pressing stress) to the electrical wire and the contact load to the stress relaxation member is equal to the fitting force of the insulation displacement terminal. Since the contact load of the stress relaxation member decreases with the lapse of time due to stress relaxation, the contact load to the electrical wire is added correspondingly. Therefore, it is possible to suppress the deterioration of the fitting force (i.e., contact load) on the electrical wire due to stress relaxation of the insulation displacement terminal.

As a result, it is possible to provide a wire connection device that obtains an electrical connection by fitting an electrical wire in an insulation displacement terminal and that is capable of maintaining a fitting force of the insulation displacement terminal to the electrical wire over a long period of time and achieving a long lifetime. Also, the wire connection device according to the aspect of the present disclosure achieves sufficient lifetime even being used under high temperature environment.

BRIEF DESCRIPTION OF THE DRAWINGS

The above and other objects, features and advantages of the present disclosure will become more apparent from the following detailed description made with reference to the accompanying drawings in which.

DETAILED DESCRIPTION

First Embodiment

Figure 1:
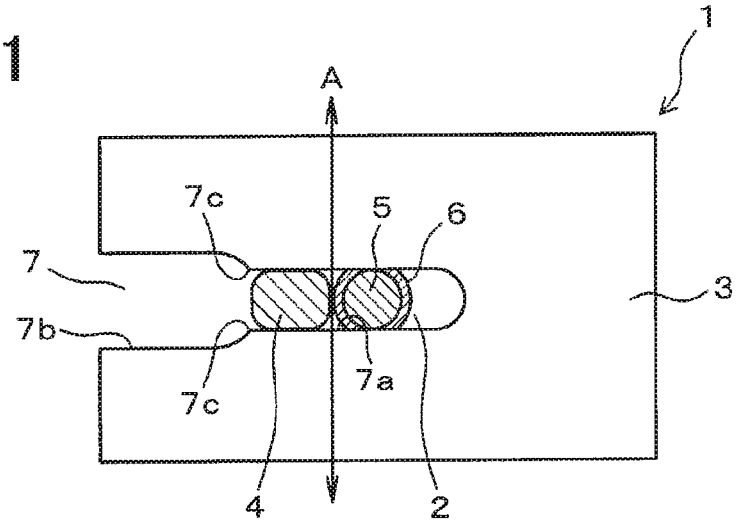
FIG. 1 is a longitudinal cross-sectional view showing a partial configuration of a wire connection device.
Figure 2:
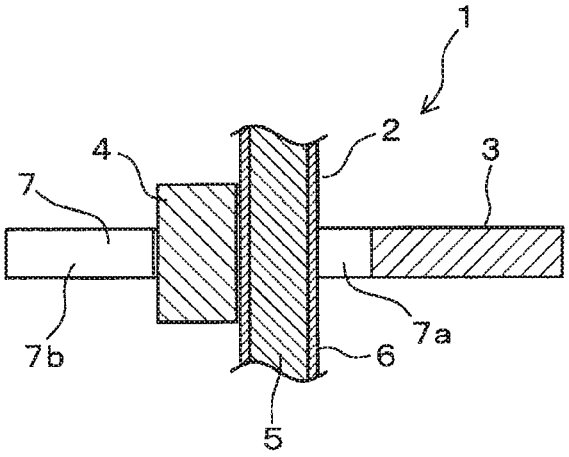
FIG. 2 is a horizontal cross-sectional view showing a partial configuration of a wire connection device.

Hereinafter, a first embodiment will be described with reference to FIGS. 1 to 5B. For example, the first embodiment is applied to a connection between an in-vehicle motor mounted on an automobile and a control substrate. FIG. 1 and FIG. 2 show a partial configuration of a wire connection device 1 according to the present embodiment. The wire connection device 1 includes an electrical wire 2, an insulation displacement terminal 3 to which the electrical wire 2 is connected by fitting, a stress relaxation member 4 and a holder, which is not shown, made of an insulating material. The holder has a hold portion for holding the electrical wire 2 and an insertion portion in which the insulation displacement terminal 3 is inserted and supported.

Figure 3:
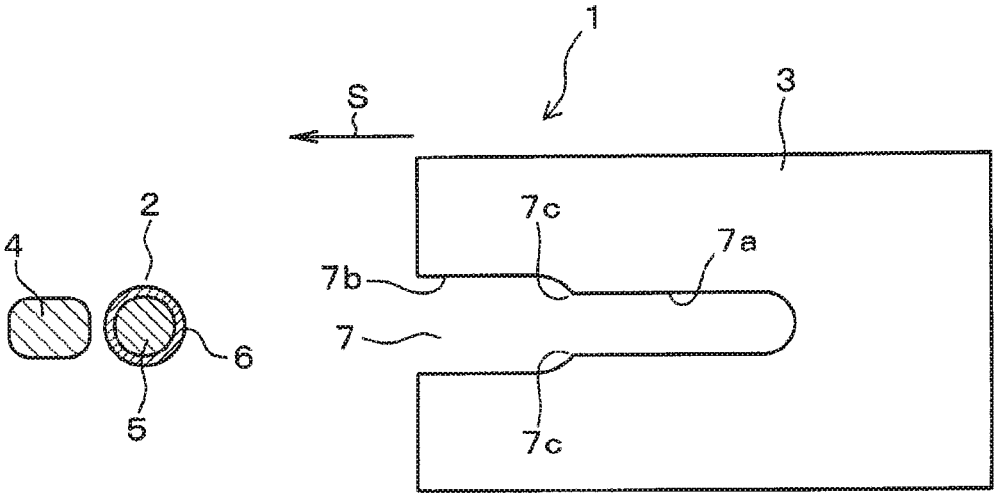
FIG. 3 is a longitudinal cross-sectional view showing a state before an electrical wire and a stress relaxation member are fitted.
Figure 4A:
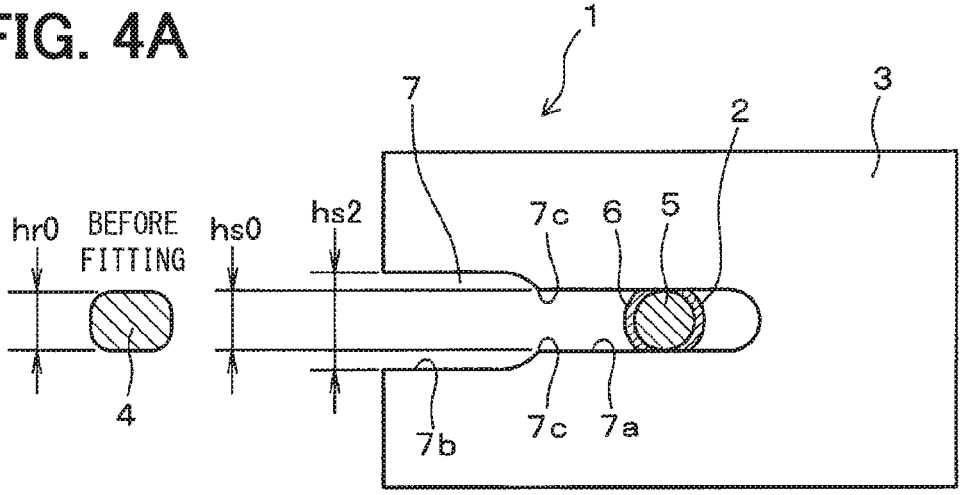
FIGS. 4A and 4B are longitudinal cross-sectional views each explaining a dimensional relationship of each part.
Figure 4B:
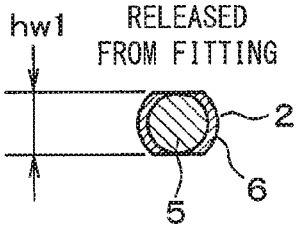

As shown in FIGS. 3, 4A and 4B, the electrical wire 2 includes a conductor 5 and an insulation coating 6 on an outer periphery of the conductor 5. For example, the conductor 5 is formed by bundling fine wires. However, the conductor 5 may be formed of one thick metal wire rod. Although not shown in detail, for example, the electrical wire 2 is used for supplying power to a stator winding of an in-vehicle motor. One end of the electrical wire 2 is held by a holder of the electrical wire connection device 1 and is connected to the stator winding through the insulation displacement terminal 3, which will be described later. The other end of the electrical wire 2 is connected to the control substrate.

For example, the insulation displacement terminal 3 is a thin metal plate having a thickness of about 1 millimeter (mm) and having a horizontally long rectangular plate shape. The insulation displacement terminal 3 has a slot 7 to which the electrical wire 2 is fitted. As shown in FIG. 1, the slot 7 is opened at a left side portion of the insulation displacement terminal 3 in FIG. 1 and is extended toward a right side portion. An inner side (i.e., right side in FIG. 1) of the slot 7 is a fitting portion 7*a* having a narrow groove width. An opening side (i.e., left side in FIG. 1) of the slot 7 is an introduction portion 7*b* having a groove width slightly wider than the fitting portion 7*a*. A boundary portion between the introduction portion 7*b* and the fitting portion 7*a* is a peeling portion 7*c*. The peeling portion 7*c* has a slightly sharp shape and cuts the insulation coating 6 of the electrical wire 2. An inner end portion of the slot 7 has a rounded semicircular shape. As a material of the insulation displacement terminal 3, for example, copper or a copper alloy having excellent conductivity is adopted.

In this case, as shown in FIGS. 4A and 4B, a width hs0 of the fitting portion 7*a* of the slot 7 is less than a width hw1 of the electrical wire 2 released from fitting. A width hs2 of the introduction portion 7*b* of the slot 7 is slightly greater than a thickness (i.e., diameter) of the electrical wire 2. The electrical wire 2 is relatively inserted in the introduction portion 7*b* from the opening and pressed into the fitting portion 7*a*. As such, the electrical wire 2 is fitted in the slot 7. Both side portions of the fitting portion 7*a* of the slot 7 are in direct contact with the conductor 5 of the electrical wire 2 without the insulation coating 6 and press the conductor 5 from both sides elastically and plastically. The both side portions of the fitting portion 7*a* elastically and plastically pinch and hold the electrical wire 2. As such, the electrical wire 2 and the insulation displacement terminal 3 are connected.

The stress relaxation member 4 is provided to suppress a deterioration of the stress (e.g., contact load) applied to the electrical wire 2 fitted in the insulation displacement terminal 3. The stress relaxation member 4 is fitted in the slot 7 (i.e., fitting portion 7*a*) of the insulation displacement terminal 3. As shown in FIGS. 1 and 2, the stress relaxation member 4 has a rectangular parallelepiped shape which is slightly long in a front-rear direction (i.e., vertical direction in FIG. 2). In the present embodiment, the stress relaxation member 4 is made of a synthetic resin generally having greater stress relaxation than metal. For example, PPS, PBT or the like is adopted. As will be described later, a relaxation time of the stress relaxation of the material constituting the stress relaxation member 4 is smaller than a relaxation time of the stress relaxation of the material of the insulation displacement terminal 3 (e.g., copper or copper alloy).

As shown in FIGS. 1 and 2, the stress relaxation member 4 is fitted in the fitting portion 7*a* of the slot 7 of the insulation displacement terminal 3 together with the electrical wire 2. The electrical wire 2 and the stress relaxation member 4 are fitted in the slot 7 of the insulation displacement terminal 3 so as to be lined up in a direction orthogonal to an application axis in which a pressing force (in other words, insulation displacement force) of the insulation displacement terminal 3 is applied (i.e., axis A in FIG. 1). Further, in the present embodiment, the electrical wire 2 is disposed at inner side (i.e., right side in FIG. 1) of the fitting portion 7*a* of the slot 7, and the stress relaxation member 4 is disposed at the opening side (i.e., left side in FIG. 1) of the fitting portion 7*a*. In other words, the stress relaxation member 4 is located adjacent to an opening of the fitting portion 7*a* of the slot 7, and the electrical wire 2 is located apart from the opening of the fitting portion 7*a* of the slot 7.

In this case, as shown in FIGS. 4A and 4B, a width hr0 of the stress relaxation member 4 before fitted in the slot 7 is greater than the width hs0 of the fitting portion 7*a* of the slot 7. A width of the stress relaxation member 4 after fitted in the slot 7 is less than the width hw1 of the electrical wire 2 released from the fitting. That is, magnitude relationship of the dimension of each part shown in FIGS. 4A and 4B is described as follows.

$$hs0<hr0<hw1<hs2$$

Incidentally, dimensional differences are about several tenths millimeters.

Next, an operation of the wire connection device 1 having the above-described configuration will be described. In connecting the electrical wire 2 and the insulation displacement terminal 3 in the electrical wire connection device 1 of the present embodiment, first, as shown in FIG. 3, the electrical wire 2 is held in a hold portion of the holder while floating in the air. The stress relaxation member 4 is temporarily held to be aligned on a back side (i.e., left side in FIG. 3) of the electrical wire 2. In this state, the insulation displacement terminal 3 is moved in an insertion direction (i.e., a direction shown by an arrow S in FIG. 3) with respect to the insertion portion of the holder while having the opening of the slot 7 in the front.

Then, the electrical wire 2 is relatively inserted into the slot 7 of the insulation displacement terminal 3 and is fitted to the fitting portion 7*a* through the introduction portion 7*b* and the peeling portion 7*c*. At this time, the electrical wire 2 passes through the introduction portion 7*b*. Then, the electrical wire 2 is pressed and fitted into the fitting portion 7*a* while having the insulation coating 6 cut by the peeling portion 7*c*. Both side portions of the fitting portion 7*a* of the slot 7 are in contact with the conductor 5, and the electrical connection is achieved. Subsequently, the stress relaxation member 4 is relatively inserted into the slot 7 of the insulation displacement terminal 3 and press-fitted into the fitting portion 7*a* through the introduction portion 7*b*. Then, as shown in FIGS. 1 and 2, the stress relaxation member 4 is lined up with the electrical wire 2 and fitted in the fitting portion 7*a*.

At this time, both side portions of the slot 7 (i.e., fitting portion 7*a*) of the insulation displacement terminal 3 are bent so as to be expanded in the width direction by the electrical wire 2 and the stress relaxation member 4, and a spring force is generated. The spring force acts as a stress (e.g., contact load) fitting and holding the electrical wire 2 and the stress relaxation member 4. At this time, the sum of the contact load to the electrical wire 2 and the contact load to the stress relaxation member 4 is equal to the fitting force of the insulation displacement terminal 3. It is known that the fitting force of the insulation displacement terminal 3 decreases with the passage of time after fitting due to stress relaxation.

Figure 5A:
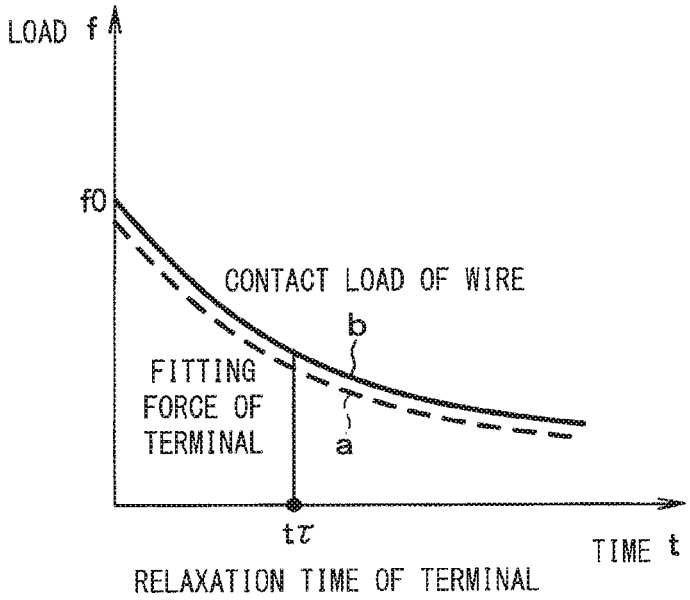
FIGS. 5A and 5B are diagrams each explaining variation of contact load over time.
Figure 5B:
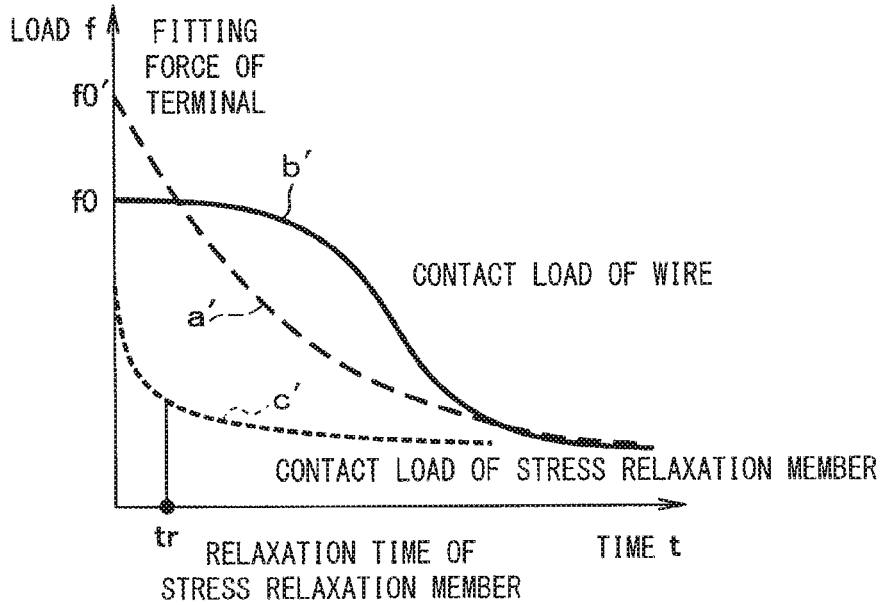

However, concurrently with the stress relaxation in the insulation displacement terminal 3, in the stress relaxation member 4 made of synthetic resin, the reaction force against the spring force of the insulation displacement terminal 3 gradually decreases with the passage of time as a result of stress relaxation. Therefore, since the contact load of the stress relaxation member 4 decreases, the contact load to the electrical wire 2 is added correspondingly. FIGS. 5A and 5B shows variation in the contact load f applied to the electrical wire in accordance with a lapse of time t after fitting. FIG. 5A shows the variation in the conventional configuration without the stress relaxation member 4. FIG. 5B shows the variation in the configuration of the present embodiment with the stress relaxation member 4. As shown in FIG. 5A, in the conventional configuration, the fitting force a of the insulation displacement terminal and the contact load b of the electrical wire coincide with each other, and the load f gradually decreases as time t passes. In this case, the time required for the fitting force a of the insulation displacement terminal to decrease to 1/e (i.e., 1/2.72) of the initial value f0 is defined as a relaxation time tτ.

In contrast, in the present embodiment, as shown in FIG. 5B, the fitting force a' of the insulation displacement terminal 3 coincides with the sum of the contact load b' of the electrical wire 2 and the contact load c' of the stress relaxation member 4. When the relaxation time tr of the stress relaxation member 4 falls below the relaxation time tτ, the difference between the fitting force a' of the insulation displacement terminal 3 and the contact load c' of the stress relaxation member 4 is added as the contact load b' of the electrical wire 2. As a result, the deterioration of the contact load b' of the electrical wire 2 is suppressed as compared with the case where the stress relaxation member 4 is not provided. Further, since the initial value f0' of the fitting force a' of the insulation displacement terminal 3 is set larger than the above f0, even if the stress relaxation member 4 is provided, the initial value of the contact load b' of the electrical wire 2 is equivalent to the conventional value (i.e., f0).

As described above, according to the present embodiment, the stress relaxation member 4 is provided in the wire connection device obtaining the electrical connection by fitting the electrical wire 2 in the insulation displacement terminal 3. The stress relaxation member 4 is fitted in the slot 7 of the insulation displacement terminal 3 and suppresses the deterioration of the stress on the electrical wire 2. As a result, the fitting force to the electrical wire 2 by the insulation displacement terminal 3 is maintained over a long period of time, and thus a long lifetime is obtained. Also, required lifetime is sufficiently obtained even in a high-temperature environment such as being used in a vehicle.

In the present embodiment, the electrical wire 2 and the stress relaxation member 4 are fitted in the slot 7 of the insulation displacement terminal 3 so as to be lined up in a direction orthogonal to the application axis A in which the pressing force of the insulation displacement terminal 3 is applied. Accordingly, the sum of the contact load of the electrical wire 2 and the contact load of the stress relaxation member 4 coincides with the fitting force of the insulation displacement terminal 3. In the slot 7, the electrical wire 2 is disposed in the inner side (i.e., a side apart from the opening) and the stress relaxation member 4 is disposed in the opening side (i.e., a side adjacent to the opening). Therefore, for example, it is restricted that electrical resistance is increased due to contamination or adhesion of foreign matter to the fitting portion 7*a* of the slot 7 caused by the fitting (i.e., insertion) of the stress relaxation member 4 prior to the electrical wire 2.

The stress relaxation member 4 is made of the material having the relaxation time of the stress relaxation less than the relaxation time of the stress relaxation of the insulation displacement terminal 3. In the present embodiment, the stress relaxation member 4 is made of the synthetic resin. As a result, the stress relaxation of the stress relaxation member 4 progresses in a relatively short period after fitting. Therefore, a large contact load on the electrical wire 2 can be maintained over a long period of time from early stage. Furthermore, in the present embodiment, the width hr0 of the stress relaxation member 4 before fitted in the slot 7 is greater than the width hs0 of the fitting portion 7*a* of the slot 7. The width of the stress relaxation member 4 after fitted in the slot 7 is less than the width hw1 of the electrical wire 2 released from the fitting. Accordingly, the width hr0 of the stress relaxation member 4 can be appropriately secured and the fitting force of the insulation displacement terminal 3 to the electrical wire 2 can be effectively maintained over a long period of time.

Second Embodiment

Next, a second embodiment will be described with reference to FIGS. 6 to 8B. In each of the embodiments described below, regarding the same parts as those of the first embodiment, detailed description will be omitted and the same reference numerals will be used. Hereinafter, parts different from the first embodiment will be mainly described.

A wire connection device 11 according to the present embodiment is different from the first embodiment in a configuration of an insulation displacement terminal 12. The insulation displacement terminal 12 is a thin metal plate having a horizontally long rectangular plate shape. The insulation displacement terminal 12 has a slot 13 opened toward a left side and extending toward a right side in FIG. 6. An opening side (i.e., left side in FIG. 6) portion of the slot 13 includes an introduction portion 13*a* having a slightly larger groove width. An intermediate portion of the slot 13 includes a peeling portion 13*b* and a first fitting portion 13*c*. The first fitting portion 13*c* and the introduction portion 13*a* communicate with each other through the peeling portion 13*b*. An inner side (i.e., right side in FIG. 6) portion of the slot 13 includes a second fitting portion 13*e*. The first fitting portion 13*c* and the second fitting portion 13*e* communicate with each other through a wide portion 13*d*.

Figure 7:
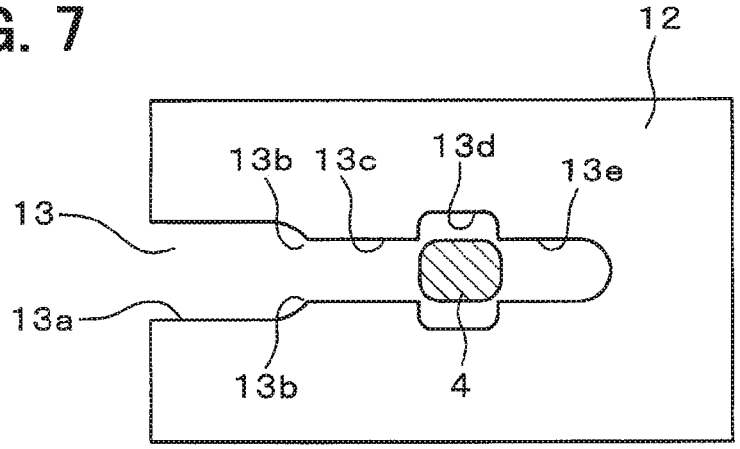
FIG. 7 is a longitudinal cross-sectional view showing a state in which a stress relaxation member is inserted into a wide portion.

In the present embodiment, in the slot 13 of the insulation displacement terminal 12, the stress relaxation member 4 is fitted to the second fitting portion 13*e* at the inner side, and the electrical wire 2 is fitted to the first fitting portion 13*c* at the opening side. The wide portion 13*d* is provided so that the stress relaxation member 4 is fitted to the second fitting portion 13*e* without passing through the opening and the first fitting portion 13*c* of the slot 13. As shown in FIG. 7, the wide portion 13*d* has a size so that the stress relaxation member 4 can be inserted in a surface direction of the insulation displacement terminal 12 and can be fitted in the second fitting portion 13*e* by being slid toward the inner side of the insulation displacement terminal 12.

Figure 8A:
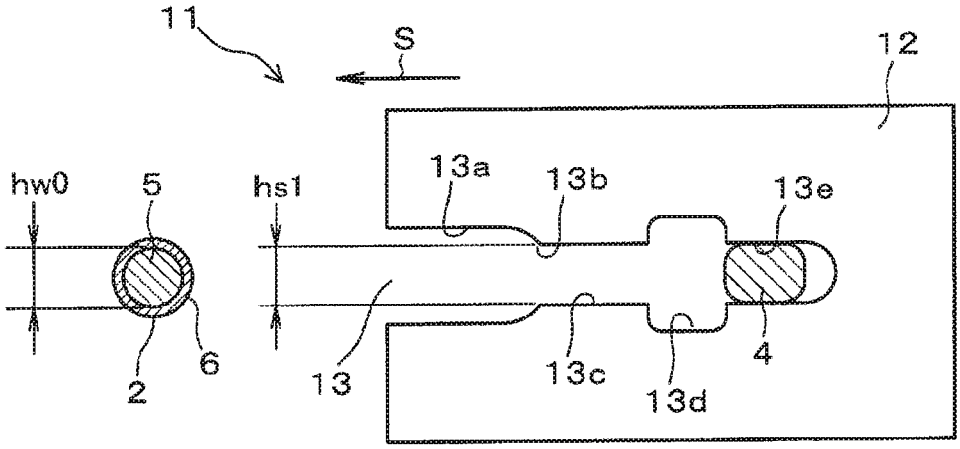
FIGS. 8A and 8B are longitudinal cross-sectional views each explaining a dimensional relationship of each part.
Figure 8B:
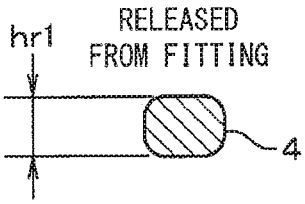

In this case, as shown in FIGS. 8A and 8B, a width hs1 of each of the first fitting portion 13*c* and the second fitting portion 13*e* of the slot 13 is less than a width (i.e., diameter) hw0 of the conductor 5 of the electrical wire 2. The width (i.e., diameter) hw0 of the conductor 5 of the electrical wire 2 is slightly less than a width hr1 of the stress relaxation member 4 released from the fitting. The electrical wire 2 is relatively inserted in the slot 13 from the opening and pressed into the first fitting portion 13*c* through the introduction portion 13*a* while having the insulation coating 6 broken by the peeling portion 13*b*.

Figure 6:
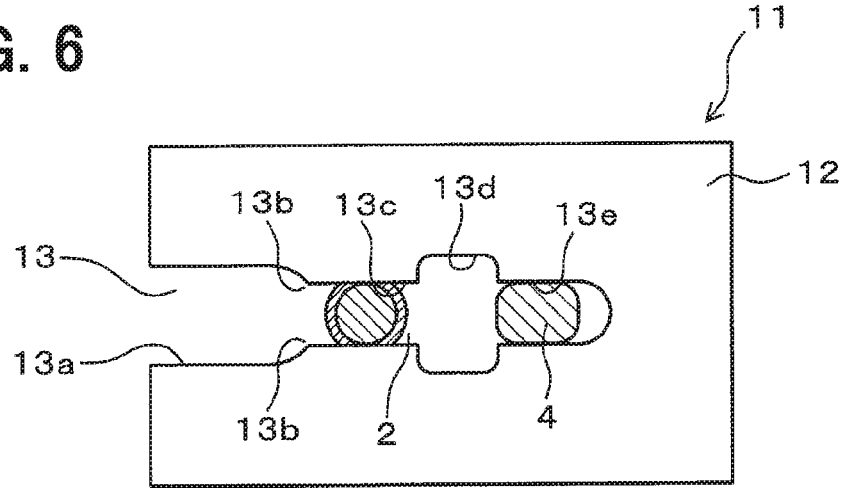
FIG. 6 is a longitudinal cross-sectional view showing a partial configuration of a wire connection device.

In the wire connection device 11 according to the second embodiment, as shown in FIG. 7, the stress relaxation member 4 is preliminarily fitted in the second fitting portion 13*e* of the slot 13 through the wide portion 13*d* of the slot 13 of the insulation displacement terminal 12. Then, as shown in FIG. 8A, the insulation displacement terminal 12 is inserted in the direction shown by the arrow S with respect to the electrical wire 2 held by the holder. As a result, the electrical wire 2 is relatively inserted into the slot 13 and fitted in the first fitting portion 13*c* through the introduction portion 13*a* and the peeling portion 13*b*. Accordingly, as shown in FIG. 6, the electrical wire 2 and the stress relaxation member 4 are lined up with each other and fitted in the slot 13.

According to the second embodiment, similarly to the first embodiment, the stress relaxation member 4 is provided in the wire connection device obtaining the electrical connection by fitting the electrical wire 2 to the insulation displacement terminal 12. The stress relaxation member 4 is fitted in the slot 13 of the insulation displacement terminal 12 and suppresses the deterioration of the stress on the electrical wire 2. As a result, the fitting force to the electrical wire 2 by the insulation displacement terminal 12 is maintained over a long period of time, and thus a long lifetime is obtained.

In particular, in the present embodiment, the slot 13 include the wide portion 13*d* allowing the passage and fitting of the stress relaxation member 4. The wide portion 13*d* provides variety in the fitting position of the electrical wire 2 and the stress relaxation member 4 and the order of the fitting procedure. Therefore, the fitting position and the order of the fitting procedure desired by the user can be achieved. For example, the stress relaxation member 4 may be preliminarily fitted to the second fitting portion 13*e* at the inner side of the slot 13 through the wide portion 13*d*. Then, the electrical wire 2 may be inserted into the first fitting portion 13*c* of the slot 13. In this case, workability can be improved. The order of fitting of the stress relaxation member 4 and the electrical wire 2 may be reversed.

Third Embodiment

Figure 9:
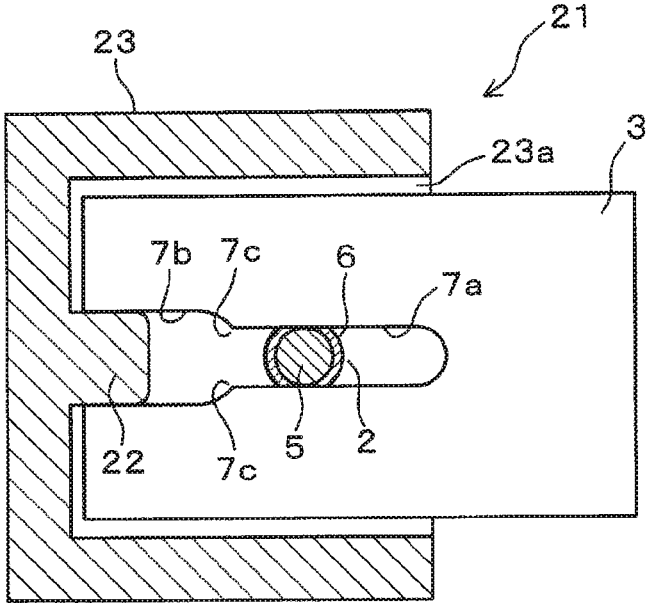
FIG. 9 is a longitudinal cross-sectional view showing a partial configuration of a wire connection device.
Figure 10A:
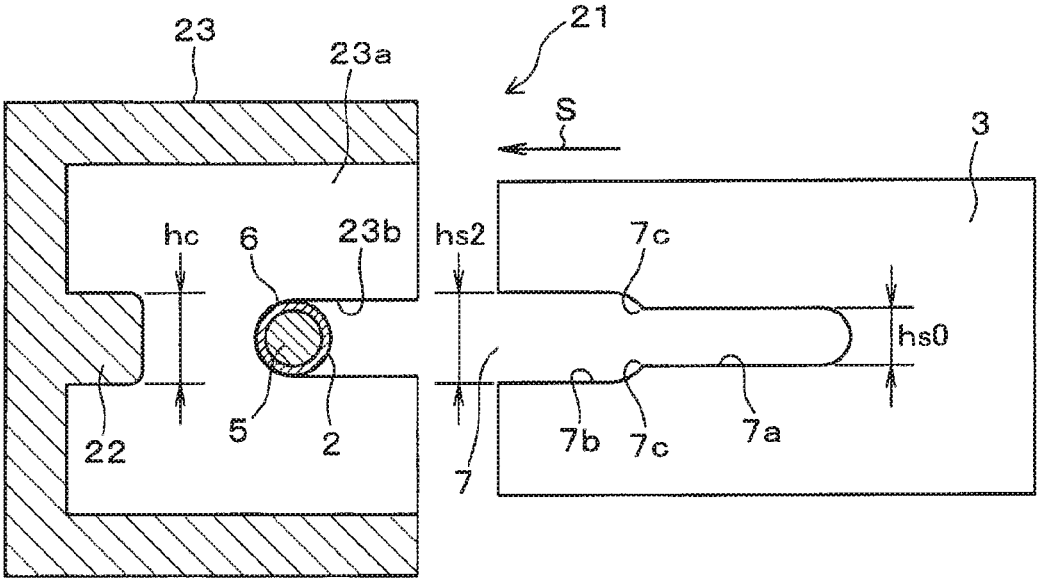
FIGS. 10A and 10B are longitudinal cross-sectional views each explaining a state before insertion of an insulation displacement terminal and a dimensional relationship of each part.
Figure 10B:
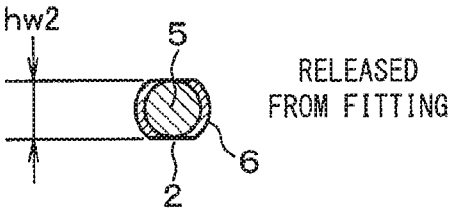

FIG. 9, FIG. 10A and FIG. 10B show a third embodiment. A wire connection device 21 according to the third embodiment is different from the first and second embodiments in that the stress relaxation member 22 is integrally provided with a holder 23. The holder 23 is made of a synthetic resin and has a rectangular box shape in which a right wall portion is opened as shown in FIG. 9. The holder 23 has an insertion portion 23*a* into which the insulation displacement terminal 3 is inserted and supported. Front and rear walls of the insertion portion 23*a* in the drawings provide a hold portion 23*b* that holds a vicinity of the portion of the electrical wire 2 connected to the insulation displacement terminal 3.

In the present embodiment, similarly to the first embodiment, the insulation displacement terminal 3 has a slot 7 including an introduction portion 7*b*, a peeling portion 7*c*, and a fitting portion 7*a*. The insulation displacement terminal 3 is inserted in the direction shown by the arrow S with respect to the insertion portion 23*a* of the holder 23. At this time, the electrical wire 2 is relatively inserted into the slot 7, fitted into the fitting portion 7*a*, and is held by the insertion portion 23*a* of the holder 23. The stress relaxation member 22 is integrally provided with the holder 23 so as to protrude rightward in the drawings from an inner left wall portion of the insertion portion 23*a* and is fitted (e.g., press-fitted) to the introduction portion 7*b*, which is the opening portion of the slot 7. The stress relaxation member 22 suppresses deterioration in stress on the electrical wire 2.

At this time, in the present embodiment, the width hc of the stress relaxation member 22 before fitting is greater than the width hs2 of the opening portion (i.e., introduction portion 7*b*) of the slot 7. The width hc of the stress relaxation member 22 is less than a value obtained by adding the width hs2 of the opening portion to a difference between the width hw2 of the electrical wire 2 released from the fitting and the width hs0 of the inner portion (i.e., fitting portion 7*a*) of the slot 7.

That is, dimensional relationship is as follows.

$$hs2<hc<\{hs2+(hw2-hs0)\}$$

In the wire connection device 21 of the present embodiment, by inserting the insulation displacement terminal 3 into the insertion portion 23*a* of the holder 23, the electrical wire 2 is relatively inserted into the slot 7 and fitted to the fitting portion 7*a*. At the same time, the stress relaxation member 22 is relatively inserted into the opening portion of the slot 7 and fitted into the introduction portion 7*b*. As a result, similarly to the first and second embodiments, the electrical wire 2 and the stress relaxation member 22 are fitted and held in the slot 7 of the insulation displacement terminal 3. Therefore, by providing the stress relaxation member 22, the deterioration in the contact load of the electrical wire 2 is suppressed as compared with the configuration in which the stress relaxation member 22 is not provided.

According to the third embodiment, similarly to the first embodiment and the second embodiment, the stress relaxation member 22 is provided in the wire connection device obtaining the electrical connection by fitting the electrical wire 2 to the insulation displacement terminal 3. The stress relaxation member 22 is fitted in the slot 7 of the insulation displacement terminal 3 and suppresses the deterioration of the stress on the electrical wire 2. As a result, the fitting force to the electrical wire 2 by the insulation displacement terminal 3 is maintained over a long period of time, and thus a long lifetime is obtained.

In particular, in the present embodiment, since the stress relaxation member 22 is integrally provided with the holder 23, it is not necessary to separately provide a stress relaxation member, and the configuration is simplified accordingly. Moreover, in the insertion of the insulation displacement terminal 3 into the holder 23, the stress relaxation member 22 is automatically fitted in the slot 7. Therefore, the procedure of fitting the stress relaxation member 22 is simplified. In the present embodiment, the width hc of the stress relaxation member 22 can be appropriately secured and the fitting force of the insulation displacement terminal 3 to the electrical wire 2 can be effectively maintained over a long period of time.

Other Embodiments

The material and shape of the stress relaxation member, the shape of the slot of the insulation displacement terminal, and the like described in the above embodiments are mere examples, and various modifications are possible. Also, the application of the wire connection device is applicable not only to the in-vehicle motor, but also to the general electrical connection of electrical wires of various devices. Although the present disclosure is described based on the above embodiments, the present disclosure is not limited to the embodiments and the structures. Various changes and modification may be made in the present disclosure. Furthermore, various combination and formation, and other combination and formation including one, more than one or less than one element may be made in the present disclosure.

What is claimed is:

1. A wire connection device comprising:

an electrical wire that includes a conductor and an insulation coating on an outer periphery of the conductor;

a metal insulation displacement terminal that has a slot in which the electrical wire is fitted, the slot being defined between metal side portions of the metal insulation displacement terminal, the metal insulation displacement terminal being connected to the electrical wire by both of the metal side portions of the slot being in direct contact with the conductor and pressing the conductor elastically and plastically; and a synthetic resin stress relaxation member that is fitted in the slot of the metal insulation displacement terminal to suppress deterioration of a stress applied to the electrical wire, wherein the electrical wire and the synthetic resin stress relaxation member are lined up in a direction orthogonal to an application axis in which a pressing force of the metal insulation displacement terminal is applied in the slot, and the synthetic resin stress relaxation member is made of a material having a relaxation time of stress relaxation less than a relaxation time of stress relaxation in the metal insulation displacement terminal.

2. The wire connection device according to claim 1, wherein a width of the synthetic resin stress relaxation member before fitted in the slot is greater than a width of the electrical wire fitted in the slot, and a width of the synthetic resin stress relaxation member after fitted in the slot is less than a width of the electrical wire released from being fitted in the slot.

3. The wire connection device according to claim 1, wherein the synthetic resin stress relaxation member is located adjacent to an opening of the slot of the metal insulation displacement terminal, and the electrical wire is located apart from the opening of the slot.

4. The wire connection device according to claim 1, wherein the slot of the metal insulation displacement terminal includes a wide portion that allows the synthetic resin stress relaxation member to be fitted in the slot without passing through an opening of the slot.

5. The wire connection device according to claim 4, wherein the electrical wire is located adjacent to the opening of the slot of the metal insulation displacement terminal, and the synthetic resin stress relaxation member is located apart from the opening of the slot.

6. The wire connection device according to claim 1, further comprising:

a holder that holds a vicinity of a part of the electrical wire connected to the metal insulation displacement terminal, wherein the metal insulation displacement terminal is inserted and supported in the holder, and the synthetic resin stress relaxation member is integrally provided with the holder.

7. The wire connection device according to claim 6, wherein the slot of the metal insulation displacement terminal includes an opening portion adjacent to an opening of the slot and an inner portion apart from the opening, the opening portion has a width greater than the inner portion, the synthetic resin stress relaxation member is fitted in the opening portion, the electrical wire is fitted in the inner portion, and a width of the synthetic resin stress relaxation member before fitted in the opening portion is:

greater than the width of the opening portion of the slot; and less than a value obtained by adding the width of the opening portion to a difference between a width of the electrical wire released from being fitted in the inner portion and a width of the inner portion of the slot.

* * * * *